US005182992A

United States Patent [19]

Rogge

[11] Patent Number: 5,182,992

[45] Date of Patent: Feb. 2, 1993

[54] DOCTOR DEVICE FOR THE SELF-WASHING INKING UNIT OF A ROTARY PRINTING PRESS

[75] Inventor: Dieter Rogge, Lengerich, Fed. Rep. of Germany

[73] Assignee: Windmöller & Hölscher, Lengerich, Fed. Rep. of Germany

[21] Appl. No.: 643,991

[22] Filed: Jan. 22, 1991

[30] Foreign Application Priority Data

Jan. 22, 1990 [DE] Fed. Rep. of Germany ..... 4001733

[51] Int. Cl.[5] ..... B41F 31/04; B41F 31/06; B41L 27/08

[52] U.S. Cl. ..... 101/363; 101/366

[58] Field of Search ..... 101/366, 363, 350, 364, 101/148, 207, 208, 209, 210; 118/259, 261

[56] References Cited

U.S. PATENT DOCUMENTS

| | | | |
|---|---|---|---|
| 3,400,658 | 9/1968 | Gagliardi et al. | 101/366 |
| 4,414,900 | 11/1983 | Kraus et al. | 101/363 |
| 4,590,855 | 5/1986 | Schommer et al. | 101/157 |
| 4,754,701 | 7/1988 | Batke | 101/207 |
| 4,958,561 | 9/1990 | Grosshauser et al. | 101/363 |

FOREIGN PATENT DOCUMENTS

| | | |
|---|---|---|
| 0222118 | 5/1987 | European Pat. Off. . |
| 3135711 | 2/1983 | Fed. Rep. of Germany . |
| WO89/7047 | 8/1989 | World Int. Prop. O. . |

*Primary Examiner*—J. Reed Fisher

*Attorney, Agent, or Firm*—Keck, Mahin & Cate

[57] ABSTRACT

A doctor device for the washing inking unit of a rotary printing press includes a doctor carrier, on which two doctor blades are attached. The doctor blades are parallel to and coextensive with each other and are able to be put into engagement with an inking roller. Together with the inking roller, the doctor carrier and sealing means provided at the end thereof, the doctor blades define a sealed ink chamber. The ink is supplied to and removed from the ink chamber through ducts. The doctor carrier is able to be brought into engagement with the inking roller by sealing moldings. In order to ensure that no ink is able to escape from the ink chamber, even when the doctor device oscillates, the sealing moldings are formed of elastic or elastomeric material, which, on their sides facing the inking roller, have dihedral, downwardly sloping surfaces for supporting the end parts of the doctor blades. Between the dihedral surfaces, a curved sealing surface is provided. The curved sealing surface has the shape of a cylindrical shell and is able to be brought into engagement with the inking roller. The sealing surface has a radius of curvature corresponding to the inking roller.

8 Claims, 2 Drawing Sheets

FIG. 3
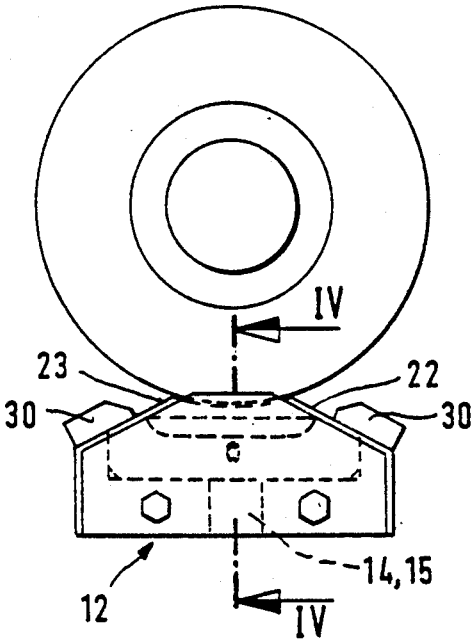
FIG. 4
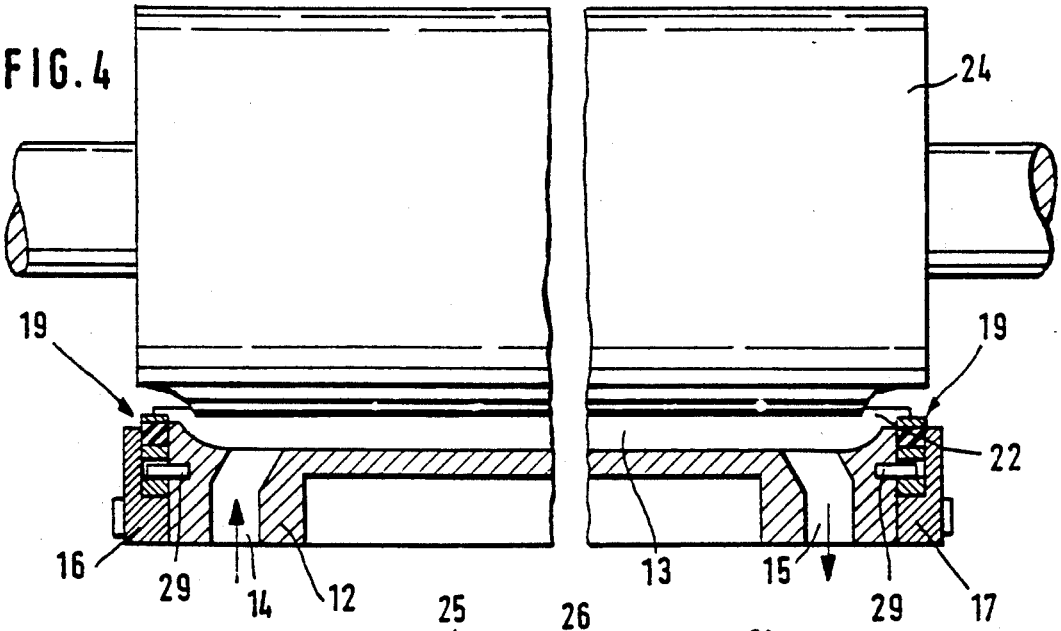
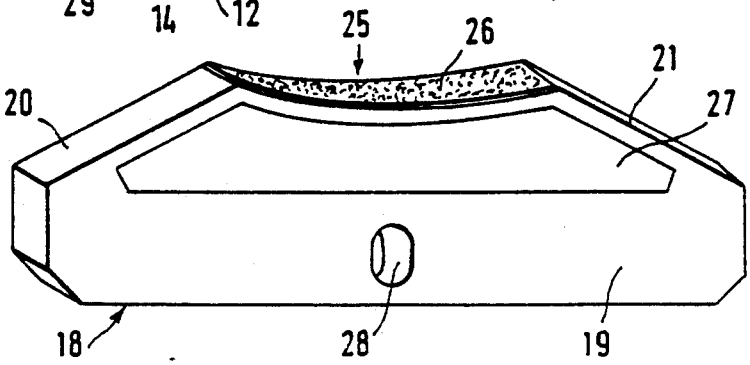
FIG. 5

DOCTOR DEVICE FOR THE SELF-WASHING INKING UNIT OF A ROTARY PRINTING PRESS

BACKGROUND OF THE INVENTION

1. Field of the Invention

This invention relates to a doctor device for a self-washing inking unit of a rotary printing press. The doctor device includes a doctor carrier, on which two doctor blades are attached. The doctor blades are are parallel to each other, and are able to brought into engagement with an inking roller. Together with the inking roller, the doctor carrier, and sealing means provided terminally on the latter, the doctor blades define a closed ink chamber. Ducts for the supply of ink to and removal of ink from the ink chamber are provided, as are loading means for pressing the doctor carrier against the inking roller.

2. Description of the Related Art

An example of a doctor device of this type is described in German patent publication 3,135,711 A, and is schematically illustrated in FIGS. 1 and 2 of the drawings. This doctor device consists of a doctor carrier 1, which, on its side facing the engraved roller 5, has a trough-like recess. The doctor carrier 1 is provided with downwardly sloping, dihedral support surfaces, placed symmetrically relative to its longitudinal median plane II—II. The support surfaces support the doctor blades 7 and 8, which are screwed to the doctor carrier in a known manner using clamping members 30. The ends of the doctor carrier 2 are provided with terminal sheet metal members 3 and 4 in order to produce sealed joints between the doctor carrier and the end faces of the doctor roller 5. Between the terminal sheet metal members 3 and 4 and the end faces of the doctor roller 5, small lateral gaps remain, which make it possible for a reciprocating motion of the doctor device to take place parallel to the longitudinal axis of the doctor roller 5. Besides being sealed off by the two lateral terminal sheet metal members 3 and 4, the ink chamber 2 is sealed off by doctor blades 7 and 8, which are in engagement with the doctor roller 5. It is possible for ink to emerge through the lateral gaps 6. Such ink is then caught by an ink sump 9, provided underneath the doctor roller 5.

The doctor carrier 1 may be pressed against the engraved roller 5 and moved clear of the same by an engaging device which is not illustrated. The ink necessary for printing is pumped through an ink feed hole 10 provided in the doctor carrier 1, and into the ink chamber 2, the excess quantity of ink being returned through the ink return hole 11 into the ink container. This known doctor device operates satisfactorily as such. However, there is a disadvantage, in that it is possible for ink to emerge from the ink chamber through the lateral gaps 6. This ink then has to be caught in an open ink sump 9, and the doctor device will be soiled by the emerging ink. Also, solvent may evaporate from the ink, which then contaminates the atmosphere. Furthermore such evaporation of the solvent means that more solvent is used.

SUMMARY OF THE INVENTION

Accordingly, one object of the invention is to provide a doctor device of the type initially mentioned, which is provided with an ink chamber incorporating sealing means engaging the inking roller, and from which it is not possible for ink to escape, even when the doctor device is oscillated in relation to the inking roller.

In order to achieve this in a doctor device of the type initially mentioned, the sealing means includes moldings of elastic or elastomeric material, which, at sides thereof facing the inking roller, have downwardly sloping, dihedral sealing surfaces for mounting the terminal parts of the doctor blades. Between the moldings, there is a respective sealing surface, which is able to be put in engagement with the inking roller and has the form of a cylindrical shell with a radius of curvature corresponding to the radius of the inking roller. The moldings constructed in accordance with the invention ensure a satisfactory sealing action of the ink chamber, since they contact both the doctor blades and also the circumferential surface parts of the inking roller. The moldings are, in the present case, pressed sufficiently firmly against the inking roller so that there is no gap between the moldings and the inking roller, and the doctor blades, through which the ink might be able to leak.

It is, preferably, the case that the sealing surface is both curved in the form of a segment of a cylindrical shell and is formed of elastic and/or plastic material with a good resistance to wear. In this case, it is particularly advantageous if the layer forming the sealing surface is formed of a tetrafluorethylene polymer, such as Teflon. Furthermore, the layer may be formed of a mixture of Teflon and copper or, alternatively, copper powder, so that good thermal conduction is ensured.

In a preferred embodiment of the invention, the molding is provided with a recess or an aperture which is filled with soft elastic material. In accordance with a further, particularly useful feature, this soft elastic material is cellular rubber. Cellular rubber has a satisfactory elasticity and owing to its cellular structure, is not able to absorb and thus become clogged with ink.

As part of a further convenient form of the invention, the recess or aperture of each molding is bounded or limited towards the sealing surfaces by a marginal rim of substantially constant thickness. Thus, there is a generally equal resilient pressing action of the sealing surface.

The moldings may be held in place in recesses in holding members, which, at their end surfaces, are attached by screws to the doctor carrier. The doctor carrier may be provided with retaining bolts at their ends so that the moldings do not have to be squeezed to be held and so that they maintain their full elasticity with respect to their sealing surfaces.

BRIEF DESCRIPTION OF THE DRAWINGS

One working embodiment of the invention will now be described, with particular reference being made to FIGS. 3 through 5 of the drawings.

FIG. 3 is an end view, corresponding to FIG. 1, of a doctor device set in engagement with an engraved roller.

FIG. 4 is a horizontal, part sectional view similar to FIG. 2, taken through the doctor device along line IV—IV of FIG. 3.

FIG. 5 is a perspective view of a molding providing for sealing action at the end of the ink chamber.

DESCRIPTION OF THE PREFERRED EMBODIMENTS

Figure 1:
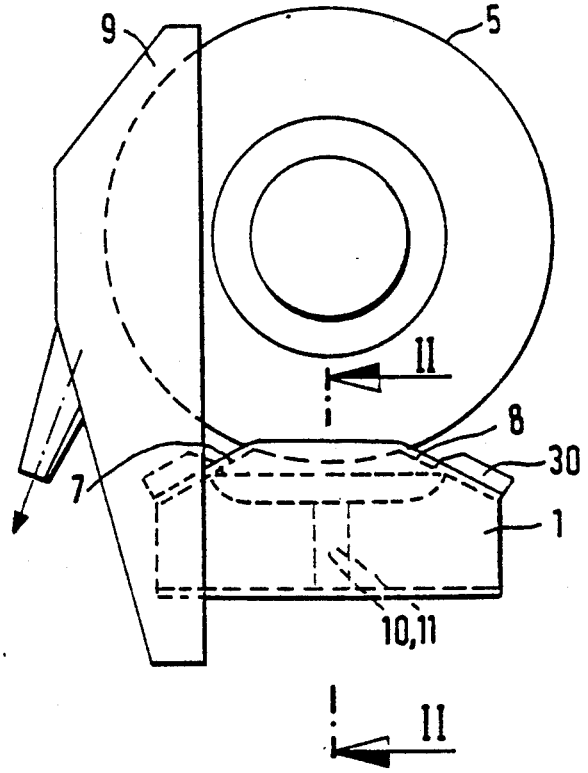
FIG. 1 (PRIOR ART)
FIG. 1 is, as noted above, a schematic illustration of a known doctor device.
Figure 2:
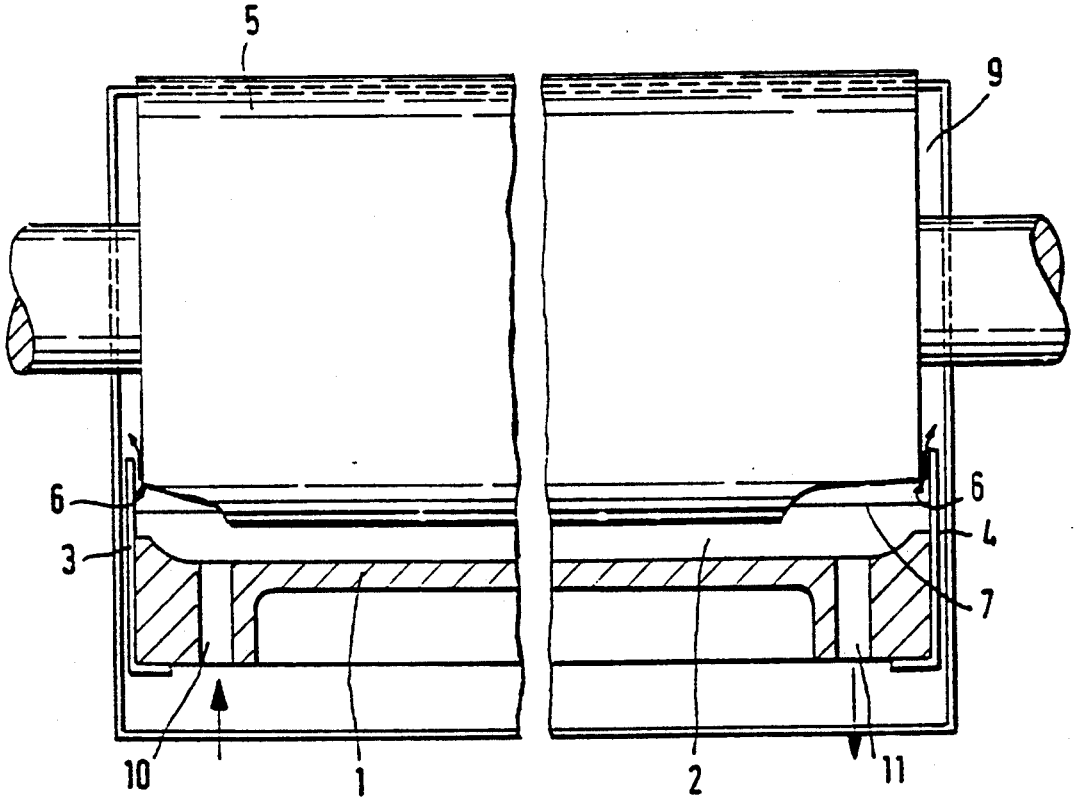
FIG. 2 (PRIOR ART)
FIG. 2 is a part sectional, side view of FIG. 1.

The doctor device illustrated in FIGS. 3 through 5 has a basic structure which corresponds to that of the doctor device illustrated in FIGS. 1 and 2. The essential difference between the device shown in FIGS. 3 through 5 and that shown in FIGS. 1 and 2 is in the presence of moldings 19, which completely seal off the ink chamber, in place of the conventionally used terminal sheet metal elements. The doctor carrier 12 is provided with an ink chamber 13, formed by a trough-like recess in the carrier. The ink chamber is supplied with ink through a hole 14 in carrier 12. Excess ink is drained off through a hole 15. A first holder 16 and a second holder 17 are attached by screws (not indicated) to opposite end surfaces of the doctor carrier 1. By means of such holders, elastic sealing elements 18 are held in place between the end surfaces of the doctor carrier 12 and the clamping members 16 and 17. As shown in FIG. 5, each sealing element 18 includes a rubber molding 19, which has two obliquely running surfaces 20 and 21. The two doctor blades 22 and 23 have their free end portions resting on these two surfaces 20 and 21. Adjoining the two oblique surfaces 20 and 21 there is an arcuate surface 25, which corresponds to the radius of the engraved roller 24. The surface 25 is preferably coated with a mixture of copper and Teflon. This layer is indicated by reference number 26. The surface 25 provides sealing engagement with the engraved roller 24, so that the ink chamber 13 is sealed off completely in relation to the engraved roller 24 by the blades 22 and 23 and, at the ends thereof, by the two rubber moldings 19.

It is also to be noted that on the one hand, owing to the use of Teflon, there is only a very small amount of friction and, on the other hand, the copper embedded in the Teflon leads to a satisfactory distribution of heat. It will furthermore be seen from FIG. 5 that a soft cellular rubber inlay 27 is placed in the rubber molding 19 in such a manner that between the cellular rubber inlay 27 and the engraved roller 24, there is only a thin strip of the rubber molding material. Since the cellular rubber 27 is softer than the rubber molding, feed movement of the ink chamber doctor may readily take place as necessary when there is wear of the doctor blades, since the cellular rubber is very readily compressed. Owing to the particular design of the rubber molding, that is to say, owing to the small thickness of the layer of the rubber material molding in between the cellular rubber and the engraved roller 24, there is an even distribution of pressure during feed movement for adjustment, so that there is always a satisfactory sealing effect between the ink chamber 13 and the terminal or end parts of the ink chamber doctor.

As shown in FIG. 4, the distance between the rubber moldings 19 is less than the length of the engraved roller 24. It is, in this manner, assured that even in the case of oscillating movement of the ink chamber doctor 12, no lateral escape of ink is possible.

The rubber moldings 19 each have a slot 28. A bolt 29, one of which is set in the ink chamber doctor 1 at each end, extends into each slot 28. It is, in this manner, assured that the rubber moldings are loosely held between the ink chamber doctor 12 and the members 16 and 17 without being squeezed.

In a conventional manner, the doctor blades are screwed by knife holders 30 to the ink chamber doctor 12, as in the known device shown in FIGS. 1 and 2.

I claim:

1. A doctor device for a self-washing inking unit of a rotary printing press, comprising:

an inking roller, a sealing means, a doctor carrier, two doctor blades, parallel to each other and able to be brought into engagement with said inking roller, attached to the doctor carrier, said doctor blades, together with the inking roller, the doctor carrier and said sealing means provided terminally on each end of the doctor carrier, defining a closed ink chamber, ducts for the supply of ink to and removal of ink from the ink chamber, and loading means for pressing the doctor carrier against the inking roller, wherein the sealing means are formed of moldings of elastic material provided with an aperture filled with a member of soft elastic material and, at a side facing the inking roller, each molding having downwardly sloping, dihedral sealing surfaces for receiving terminal parts of the doctor blades and between which there is a respective curve for a roller sealing surface, which is able to engage the inking roller, each said roller sealing surface having the form of a cylindrical shell with a radius of curvature corresponding to the radius of the inking roller.

2. A doctor device as claimed in claim 1, characterized in that the curved sealing surfaces includes a layer of deformable material with a high resistance to wear.

3. A doctor device as claimed in claim 2, characterized in that the layer is formed of Teflon.

4. A doctor device as claimed in claim 2, characterized in that the layer is formed of a mixture of Teflon and copper.

5. A doctor device as claimed in claim 1, characterized in that the soft elastic material is cellular rubber.

6. A doctor device as claimed in claim 1, characterized in that the aperture is limited towards the dihedral and curved sealing surfaces by a marginal rim of essentially constant thickness.

7. A doctor device as claimed in claim 1, characterized in that the moldings are retained in recesses of holding members, which, at end surfaces thereof, are screwed to the doctor carrier.

8. A doctor device as claimed in claim 7, characterized in that the doctor carrier is provided, at an end surface thereof, with holding bolts, which are fitted in holes in the moldings.

* * * * *